US005468583A

United States Patent [19]

Gruenbaum et al.

[11] Patent Number: 5,468,583

[45] Date of Patent: Nov. 21, 1995

[54] CYCLIC BIS-DICARBOXIMIDE ELECTRON TRANSPORT COMPOUNDS FOR ELECTROPHOTOGRAPHY

[75] Inventors: William T. Gruenbaum; Teh-Ming Kung; Ralph H. Young, all of Rochester, N.Y.

[73] Assignee: Eastman Kodak Company, Rochester, N.Y.

[21] Appl. No.: 365,524

[22] Filed: Dec. 28, 1994

[51] Int. Cl.[6] ..... G03G 5/047; G03G 5/09

[52] U.S. Cl. ..... 430/58; 430/83

[58] Field of Search ..... 430/59, 83

[56] References Cited

U.S. PATENT DOCUMENTS

| | | | |
|---|---|---|---|
| 2,610,120 | 9/1952 | Minsk et al. . | |
| 2,670,284 | 2/1954 | Zvanut . | |
| 2,670,286 | 2/1954 | Minsk et al. . | |
| 3,007,901 | 11/1961 | Minsk . | |
| 3,180,730 | 4/1965 | Klupfel et al. . | |
| 3,240,597 | 5/1966 | Fox . | |
| 3,245,833 | 5/1966 | Trevoy . | |
| 3,250,615 | 5/1966 | Van Allan et al. . | |
| 3,262,807 | 7/1966 | Sterman et al. . | |
| 3,274,000 | 9/1966 | Noe et al. . | |
| 3,542,547 | 11/1970 | Wilson . | |
| 3,567,450 | 3/1971 | Brantly et al. . | |
| 3,625,402 | 12/1971 | Kulls et al. . | |
| 3,658,520 | 4/1972 | Brantly et al. . | |
| 3,732,301 | 5/1973 | Sletzinger et al. . | |
| 3,880,657 | 4/1975 | Rasch . | |
| 4,127,412 | 11/1978 | Rule et al. . | |
| 4,150,987 | 4/1979 | Anderson . | |
| 4,368,319 | 1/1983 | Hocker et al. | 528/353 |
| 4,423,129 | 12/1983 | Takasu et al. | 430/59 |
| 4,442,193 | 4/1984 | Chen et al. | 430/83 |
| 4,446,217 | 5/1984 | Takasu et al. | 430/58 |
| 4,456,671 | 6/1984 | Mabuchi et al. | 430/58 |
| 4,468,444 | 8/1984 | Contois | 430/72 |
| 4,481,271 | 11/1984 | Hashimoto et al. | 430/57 |
| 4,487,824 | 12/1984 | Katagiri et al. | 430/58 |
| 4,554,231 | 11/1985 | Ishikawa et al. | 430/59 |
| 4,666,802 | 5/1987 | Hung et al. | 430/58 |
| 4,701,396 | 10/1987 | Hung et al. | 430/58 |
| 4,727,139 | 2/1988 | Hung et al. | 540/143 |
| 4,792,508 | 12/1988 | Kazmaier et al. | 430/59 |
| 4,841,073 | 6/1989 | Hassel et al. | 549/232 |
| 4,913,996 | 4/1990 | Kung et al. | 430/59 |
| 4,992,349 | 2/1991 | Chen et al. | 430/58 |
| 5,013,627 | 5/1991 | Harnisch et al. | 430/110 |
| 5,055,367 | 10/1991 | Law | 430/59 |
| 5,266,429 | 11/1993 | Sorriero et al. | 430/58 |
| 5,272,032 | 12/1993 | Cowdery et al. | 430/59 |

FOREIGN PATENT DOCUMENTS

| | | |
|---|---|---|
| 0031065 | 12/1979 | European Pat. Off. . |
| 1195762 | 9/1962 | Germany . |
| 1230031 | 6/1964 | Germany . |
| 2919519 | 11/1979 | Germany . |
| 5019510 | 1/1993 | Japan . |
| 5019506 | 1/1993 | Japan . |
| 5025174 | 2/1993 | Japan . |
| 5027457 | 2/1993 | Japan . |
| 5027469 | 2/1993 | Japan . |

OTHER PUBLICATIONS

Research Disclosure, vol. 109, May 1973, pp. 61–67.

P. M. Borsenberger & D. S. Weiss, Organic Photoreceptors for Imaging Systems, Marcel Dekker, New York, 1993, p. 279.

*Primary Examiner*—Roland Martin

*Attorney, Agent, or Firm*—Anne B. Kiernan

[57] ABSTRACT

This invention provides: A photoconductor element comprising:

an electrically conductive layer, a charge generating material and an electron transport agent in a polymeric binder, said electron transport agent comprising at least one cyclic bis-dicarboximide compound of Formula (I):

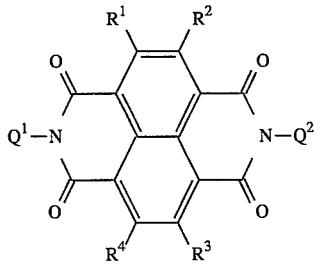

(I)

wherein:

$Q^1$ and $Q^2$, which may be the same or different, represent branched alkyl; unsubstituted straight-chain alkyl; unsubstituted cyclic alkyl; alkyl-substituted cyclic alkyl; unsubstituted, straight-chain, unsaturated alkyl; or H, wherein $Q^1$ and $Q^2$ cannot both be H; and $R^1$, $R^2$, $R^3$, and $R^4$, which may be the same or different, represent hydrogen, alkyl having 1 to 4 carbon atoms, alkoxy having 1 to 4 carbon atoms, or halogen.

20 Claims, No Drawings

CYCLIC BIS-DICARBOXIMIDE ELECTRON TRANSPORT COMPOUNDS FOR ELECTROPHOTOGRAPHY

FIELD OF THE INVENTION

This invention is in the field of compounds useful as electron transport agents in photoconductor elements. More specifically, this invention is in the field of cyclic bis-dicarboximide compounds useful as electron transport agents in photoconductor elements.

BACKGROUND OF THE INVENTION

In electrophotography, an image comprising a pattern of electrostatic potential (also referred to as an electrostatic latent image) is formed on a surface of an electrophotographic element comprising at least an insulative photoconductive layer and an electrically conductive substrate. The electrostatic latent image is usually formed by imagewise radiation-induced discharge of a uniform potential previously formed on the surface. Typically, the electrostatic latent image is then developed into a toner image by contacting the latent image with an electrophotographic developer. If desired, the latent image can be transferred to another surface before development.

In latent image formation the imagewise discharge is brought about by the radiation-induced creation of electron/hole pairs, which are generated by a material (often referred to as a charge-generation material) in the electrophotographic element in response to exposure to the imagewise actinic radiation. Depending upon the polarity of the initially uniform electrostatic potential and the type of materials included in the electrophotographic element, either the holes or the electrons that have been generated migrate toward the charged surface of the element in the exposed areas and thereby cause the imagewise discharge of the initial potential. The remaining non-uniform potential is the electrostatic latent image.

Many electrophotographic elements currently in use are designed to be initially charged with a negative polarity. Such elements contain material which facilitates the migration of positive holes toward the negatively charged surface in imagewise exposed areas in order to cause imagewise discharge. Such material is often referred to as a hole-transport agent. In elements of that type, a positively charged toner material is usually then used to develop the remaining imagewise undischarged areas of negative polarity potential, i.e., the latent image, into a toner image. Because of the wide use of negatively charging elements, considerable numbers and types of positively charging toners have been fashioned and are available for use in electrophotographic developers.

However, for some applications of electrophotography it is more desirable to be able to develop the surface areas of the element that have been imagewise exposed to actinic radiation, rather than those that remain imagewise unexposed. For example, in laser printing of alphanumeric characters it is more desirable to be able to expose the relatively small percentage of surface area that will actually be developed to form visible alphanumeric toner images, rather than waste energy exposing the relatively large percentage of surface area that will constitute undeveloped background portions of the final image. In order to accomplish this while still employing widely available high quality positively charging toners, it is necessary to use an electrophotographic element that is designed to be positively charged. Positive toner can then be used to develop the exposed surface areas, which will have, after exposure and discharge, relatively negative electrostatic potential compared to the unexposed areas, where the initial positive potential will remain. An electrophotographic element designed to be initially positively charged preferably contains an adequate electron-transport agent, that is, a material which facilitates the migration of photogenerated electrons toward the positively charged insulative element surface.

Electrophotographic elements include both those commonly referred to as single layer or single-active-layer elements and those commonly referred to as multiactive, multilayer, or multi-active-layer elements.

Single-active-layer elements are so named because they contain only one layer that is active both to generate and to transport charges in response to exposure to actinic radiation. Such elements typically comprise at least an electrically conductive layer in electrical contact with an active layer. In single-active-layer elements, the active layer contains a charge-generation material to generate electron/hole pairs in response to actinic radiation and an electron-transport and/or hole-transport agent, which comprises one or more of chemical compounds capable of accepting electrons and/or holes generated by the charge-generation material and transporting them through the layer to effect discharge of the initially uniform electrostatic potential. The active layer is electrically insulative except when exposed to actinic radiation, and it sometimes contains an electrically insulative polymeric film-forming binder, which may itself be the charge-generating material, or it may be an additional material that is not charge-generating. In either case, the transport agent(s) is (are) dissolved or dispersed as uniformly as possible in the layer.

Multiactive elements are so named because they contain at least two active layers, at least one charge generation layer (CGL) which is capable of generating charges, i.e., electron/hole pairs, in response to exposure to actinic radiation, and at least one charge transport layer (CTL) which is capable of accepting and transporting charges generated by the charge-generation layer. Such elements typically comprise at least an electrically conductive layer, a CGL, and a CTL. Either the CGL or the CTL is in electrical contact with both the electrically conductive layer and the remaining CTL or CGL. The CGL contains at least a charge-generation material; the CTL contains at least a charge-transport agent; and either or both layers can contain an electrically insulative film-forming polymeric binder.

In multiactive positively charged photoconductor elements of the type employing at least a CGL and a CTL, it is preferable to make the CTL the uppermost layer of the element to protect the more mechanically sensitive CGL from wear. To date, known electron transport agents suffer from problems upon repeated use, such as high dark decay, insufficient electronic charge transport activity, a gradually increasing residual potential or the like. Consequently, the art of photoconductor elements continues to seek new electron transport agents which exhibit sufficient sensitivity, but which do not exhibit disadvantages such as above indicated which might restrict their utilization in positively charged photoconductor elements.

Certain electron transport agents, such as trinitrofluorenone (TNF), which do exhibit a useful level of sensitivity, suffer from the further disadvantage that they are now suspected to be carcinogens.

Cyclic bis-dicarboximide compounds have previously been proposed for use in photoconductor elements. For example, U.S. Pat. Nos. 4,992,349, 4,468,444, and 4,442,193 disclose cyclic bis-dicarboximides having the following structure:

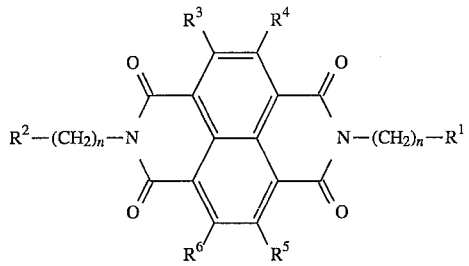

(A)

where $R^1$ and $R^2$, which may be the same or different, represent aryl; or aryl substituted with alkyl, alkoxy, perfluoroalkyl or perfluoralkoxy groups having 2 to 20 carbon atoms; sulfonyl; sulfone; sulfonamide; nitrile; or nitro groups; $R^3$, $R^4$, $R^5$, and $R^6$, which may be the same or different, represent hydrogen, alkyl having 1 to 4 carbon atoms, alkoxy having 1 to 4 carbon atoms, or halogen; and n is 0 to 3. U.S. Pat. No. 4,992,349 discloses the use of cyclic bis-dicarboximides of Structure A as electron-transport agents. U.S. Pat. Nos. 4,468,444 and 4,442,193 disclose other uses of the cyclic bis-dicarboximides of Structure A in photoconductor elements.

U.S. Pat. No. 5,266,429 discloses photoconductor elements comprising polymers which incorporate cyclic bis-dicarboximide groups of structure A, except that $R^1$ and $R^2$ are functional groups linking the cyclic bis-dicarboximide groups to the remainder of the polymer chain. The polymers can be used as binders with monomeric electron-transport agents, or they may be used as polymeric electron-transport agents. When used as polymeric electron-transport agents, they exhibit relatively poor ability to discharge upon exposure to actinic radiation.

EPO Application No. 00 31065 discloses cyclic bis-dicarboximides having the following structure:

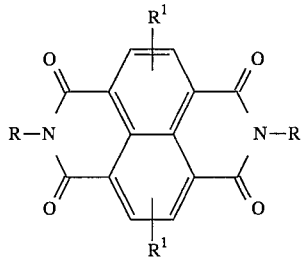

(B)

where R is a saturated or olefinically unsaturated aliphatic or cycloaliphatic residue containing an electron-donor group and each $R^1$ can independently be a hydrogen, halogen, $NO_2$, $SO_3H$, CN, $COOR^2$, $N(R^2)_2$ (where $R^2$ is hydrogen or $C_1$–$C_4$-alkyl), hydroxyl, or $C_1$–$C_4$-alkoxy.

Although cyclic bis-dicarboximide compounds have previously been proposed for use as charge transport agents in photoconductor elements, they suffer from one or more of the following drawbacks: insufficient solubility in a binder, or insufficient electron transport ability or increased dark decay. Therefore, there is a need for photoconductor elements using novel cyclic bis-dicarboximide compounds which possess improved characteristics.

SUMMARY OF THE INVENTION

This invention relates to photoconductor elements which use cyclic bis-dicarboximides as electron-transport agents.

The cyclic bis-dicarboximides are characterized by the formula:

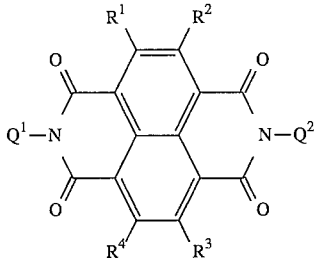

wherein:

$Q^1$ and $Q^2$, which may be the same or different, represent branched alkyl; unsubstituted straight-chain alkyl; unsubstituted cyclic alkyl; alkyl-substituted cyclic alkyl; unsubstituted, straight-chain, unsaturated alkyl; or H, wherein $Q^1$ and $Q^2$ cannot both be H; and $R^1$, $R^2$, $R^3$, and $R^4$, which may be the same or different, represent hydrogen, alkyl having 1 to 4 carbon atoms, alkoxy having 1 to 4 carbon atoms, or halogen.

The compounds of Formula I when used as electron-transport agents preferably in charge transport layers, particularly in positively charged photoconductor elements, display excellent electron transport capability, excellent solubility in binders and limited dark decay.

DETAILED DESCRIPTION OF THE INVENTION

The photoconductor element of this invention comprises a cyclic bis-dicarboximide of the formula:

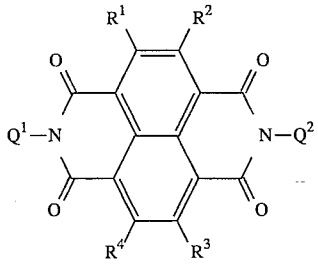

(I)

wherein:

$Q^1$ and $Q^2$, which may be the same or different, represent branched alkyl; unsubstituted straight-chain alkyl; unsubstituted cyclic alkyl; alkyl-substituted cyclic alkyl; unsubstituted, straight-chain, unsaturated alkyl; or H, wherein $Q^1$ and $Q^2$ cannot both be H; and $R^1$, $R^2$, $R^3$, and $R^4$, which may be the same or different, represent hydrogen, alkyl having 1 to 4 carbon atoms, alkoxy having 1 to 4 carbon atoms, or halogen.

Examples of the cyclic bis-dicarboximides of this invention are according to Formula I where $Q^1$ or $Q^2$ which can be the same or different are selected from the groups listed in Table 1.

TABLE 1

| $Q^1$ or $Q^2$ GROUPS | |
|---|---|
| GROUP NO. | GROUP STRUCTURE |
| 1 | $-CH(CH_3)CH(CH_3)_2$ |
| 2 | $-CH(CH_3)CH_2CH_3$ |
| 3 | $-CH(CH_3)CH_2CH(CH_3)_2$ |
| 4 | $-CH(CH_2CH_3)_2$ |
| 5 | $-CH_2CH_2CH(CH_3)_2$ |
| 6 | $-CH_2CH(CH_3)CH_2CH_3$ |
| 7 | $-CH(CH_3)CH_2CH_2CH_3$ |
| 8 | $-CH_2CH(CH_3)_2$ |
| 9 | $-CH(CH_2OH)CH_2CH_3$ |
| 10 | $-CH(CH_3)_2$ |
| 11 | -cyclopentyl |
| 12 | $-CH_2CH_2CH_2CH_2CH_3$ |
| 13 | $-CH_2CH=CH_2$ |
| 14 | -cyclohexyl |
| 15 | -cyclobutyl |
| 16 | -cyclopropyl |
| 17 | $-CH(CH_3)CH_2CH_2$Phenyl |
| 18 | $-CH(CH_3)CH_2CO_2Et$ |
| 19 | $-CH(CH_3)CH_2CH_2OCH_3$ |
| 20 | $-CH(CH_3)CH_2CH_2NO_2$ |
| 21 | $-CH(CH_3)CH_2CH_2C\equiv N$ |
| 22 | $-CH_2C\equiv CH$ |
| 23 | $-CH(CH_3)C\equiv CH$ |
| 24 | $-CH(CH_3)CH(CH_3)CH_2OH$ |
| 25 | $-CH(CH_3)CH_2CF_3$ |
| 26 | $-CH(CH_3)C\equiv C-CH_3$ |
| 27 | $-CH(CF_3)CH_2CH_3$ |
| 28 | $-CH(CF_3)CH(CH_3)_2$ |
| 29 | $-CH(CH_3)CH_2CH_2Cl$ |
| 30 | -Cyclopentyl-$CH(CH_3)CH_2CH_3$ |

When either or both of $Q^1$ and $Q^2$ are unsubstituted straight-chain alkyls, the unsubstituted straight-chain alkyls preferably consist of 1 to 10 carbon atoms, more preferably they consist of 2 to 5 carbon atoms. Examples of such groups useful in the compounds of Formula I include methyl, ethyl, propyl, butyl, pentyl, hexyl, and heptyl, etc. It is preferred that $Q^1$ and $Q^2$ be the same groups, and that the compounds of Formula I be symmetrical. The most preferred compound of Formula I having a straight-chain alkyl is N,N'-bis(n-pentyl)-1,4,5,8-naphthalenedicarboximide.

When either or both of $Q^1$ and $Q^2$ are unsubstituted cyclic alkyls, the unsubstituted cyclic alkyls preferably consist of 3 to 10 carbon atoms, more preferably they consist of 4 to 7 carbon atoms, most preferably 5 to 6 carbon atoms. Examples of such groups useful in the compounds of Formula I include cyclopropyl, cyclobutyl, cyclopentyl, cyclohexyl, and cycloheptyl. It is preferred that $Q^1$ and $Q^2$ be the same groups, and that the compounds of Formula I be symmetrical. The most preferred bis-dicarboximide having a cyclic alkyl group is N,N'-bis(cyclopentyl)-1,4,5,8-napthalenedicarboximide.

When either or both of $Q^1$ and $Q^2$ are alkyl-substituted cyclic alkyls, the alkyl-substituted cyclic alkyls preferably consist of 4 to 14 carbon atoms, more preferably 6 to 10 carbon atoms. Examples of such groups useful in the compounds of Formula I include ethyl, propyl, isopropyl, isobutyl, or tert-butyl substituted cyclopentyl or cyclohexyl groups. It is preferred that $Q^1$ and $Q^2$ be the same groups and that the compounds of Formula I be symmetrical.

When either or both of $Q^1$ and $Q^2$ are unsubstituted, straight-chain, unsaturated alkyl, the unsubstituted, straight-chain, unsaturated alkyls preferably consist of 3 to 10 carbon atoms, more preferably they consist of 3 to 6 carbon atoms. It is preferred that the unsaturated alkyl groups are either alkylenes, alkynes or allenyls. Examples of such groups useful in the compound of Formula I include vinyl, propenyl, butenyl, pentenyl, acetylenyl, propynyl, butynyl, pentynyl, and allyl. It is preferred that $Q^1$ and $Q^2$ be the same groups and that the compounds of Formula I be symmetrical. The most preferred compound having an unsubstituted straight-chain unsaturated alkyl group is N,N'-bis(allyl)-1,4,5,8-napthalenedicarboximide.

The most preferred compounds of Formula I are those where either or both of $Q^1$ and $Q^2$ are branched alkyls. The branched alkyls can be substituted or unsubstituted and they can be saturated or unsaturated. It is preferred that the branching in the alkyl group be close to the imide nitrogen atom. It is most preferred that the branching in the alkyl group be on the carbon atom attached to the imide nitrogen atom. The substituted branched alkyls can be substituted with unsaturated hydrocarbon groups selected from the group consisting of vinyl, alkylene, alkyne, and aryl or with functional groups selected from the group consisting of halogen, hydroxy, nitro, amino, alkylsulfonyl, cyano, trifluoromethyl, alkoxy, and carboalkoxy. It is preferable that the branched alkyl groups consist of 3 to 10 carbon atoms, more preferably 3 to 7 carbon atoms, most preferably 3 to 5 carbon atoms. Examples of the substituted groups are in Table 1.

The most preferred structure for either or both branched alkyl $Q^1$ and $Q^2$ groups is one of the following:

$$-CH(R^5)R^6, \text{ or } -CH(R^5)CH(R^6)R^7, \text{ or } -CH(R^5)CH_2CH(R^6)R^7$$

wherein $R^5$, $R^6$ and $R^7$, which may be the same or different, represent branched alkyl, straight chain alkyl, cyclic alkyl, unsaturated hydrocarbon groups or any of those groups substituted with any of the functional groups described earlier. $R^5$, $R^6$ and $R^7$ preferably consist of 1 to 10 carbon atoms, more preferably 1 to 5 carbon atoms, most preferably 1 to 3 carbon atoms.

In the most preferred compounds of Formula I $R^5$, $R^6$, and $R^7$ are unsubstituted, straight-chain alkyl groups consisting of 1 to 5 carbon atoms. Most preferably $Q^1$ or $Q^2$ is $CH(R^5)CH(R^6)R^7$ where $R^5$ is a methyl group and $R^6$ and $R^7$ are unsubstituted, straight-chain alkyl groups consisting of 1–4 carbon atoms. Especially preferred compounds of Formula I have isomeric butyl or isomeric pentyl groups in which the carbon bonded to the imide nitrogen is also bonded to a hydrogen, a methyl group, and an ethyl, propyl or isopropyl group.

Most of the compounds of Formula I of this invention have a minimum solubility of about 2 g in 100 mL dichloromethane (DCM) and they possess good electron transport capability in photoconductor elements.

The more preferred compounds of Formula I such as many in which $Q^1$ and $Q^2$ are branched alkyls or unsubstituted, straight-chain alkyls have solubilities in DCM greater than 5 g/100 mL. The most preferred compounds of Formula I such as many in which $Q^1$ and $Q^2$ are branched alkyls having at least two alkyl groups bonded to the carbon atom bonded to the imide nitrogen atom have solubilities in DCM greater than 10 g/100 mL.

The more preferred compounds of Formula I are the ones having relatively lower molecular weights. The lower weight compounds have good solubility properties and for a given weight percent in a charge-transport layer have a higher molar concentration and in general a higher electron mobility than higher molecular weight bis-dicarboximides.

For the most preferred compounds of Formula I, the $Q^1$ and $Q^2$ groups each possess a molecular weight less than 134, more preferably less than 99, most preferably less than 85.

The more preferred compounds of Formula I are the compounds having lower melting points, that is melting points less than 220° C., more preferably less than 200° C.

The synthesis of symmetrical compounds of Formula I is accomplished by azeotropic refluxing of two equivalents of primary amine with one equivalent of 1,4,5,8-naphthalenetetracarboxylic dianhydride. Preferred solvents for the naphthalenebisdicarboximide forming reactions are heterocyclic aromatic amines, such as pyridine, picoline, or quinoline. Better yields are obtained if the reaction is run above 110° C., rather than at steam bath temperature. These compounds are easily purified by precipitation from a good solvent, such as toluene or dichloromethane, into a poor solvent, such as alcohol or ether.

If an unsymmetrical bis-dicarboximide is desired, such as for better solubility, such a compound is most easily prepared and used as a mixture with the two symmetric compounds. The mixture can be made by reacting two different primary amines with 1,4,5,8-naphthalenetetracarboxylic dianhydride.

Additional reaction mechanisms which can be adapted to making compounds of Formula I are disclosed in the prior art. For example, see U.S. Pat. No. 4,992,349 which is incorporated herein by reference.

The compounds of Formula I are not known to be carcinogenic, are stable under ambient conditions, are readily prepared, and can be readily compounded for utilization as an electron transport agent since such compounds are readily soluble in common organic solvents, especially chlorinated solvents.

For use as an electron transport agent, preferably in a charge transport layer, a compound of Formula I is dissolved or dispersed together with a preferably dissolved, insulating, film forming binder polymer in a solvent medium, such as a chlorinated hydrocarbon, or the like. This resulting composition can be coated on a surface and then dried to provide the desired charge transport layer.

Cyclic bis-dicarboximides of Formula I which are useful as the electron transport agents of this invention are preferably soluble to an extent of at least about 25 weight percent, and preferably to an extent of at least about 40 weight percent, in an organic solvent which is suitable for use as a coating solvent. Presently preferred solvents are, for example, tetrahydrofuran, toluene, and halogenated hydrocarbons, such as 1,2-dichloroethane, 1,1,2-trichloroethane, 1,1,2-trichloropropane, 1,1,2,2-tetrachloroethane, dichloromethane, and trichloromethane.

The photoconductor elements of this invention can have any known configuration. The photoconductor elements can have one active layer comprising both a charge generation material and an electron transport agent of Formula I, or they can be multiactive elements. The multiactive elements of this invention have at least one charge generation layer having at least one charge generation material and one charge transport layer having at least one charge transport agent of Formula I. In addition to charge generation layers and charge transport layers, the photoconductor elements of this invention may consist of electrically conductive layers and optional additional layers, such as subbing layers, adhesive layers, abrasion resistant layers, and electronic charge barrier layers which are all well known in the art.

It is preferred that the photoconductor elements of this invention have dimensional stability. This can be accomplished by using an electrically conductive layer that is itself dimensionally stable, or by forming the element on a dimensionally stable conductive substrate. A dimensionally stable electrically conductive layer or the combination of an electrically conductive layer and a dimensionally stable substrate will be referred to as an electrically conductive support. A dimensionally stable substrate is preferably thermally stable and may be electrically insulating. Conventional dimensionally stable substrates such as films and sheets of polymeric materials may be used. Examples of polymers used in films include cellulose acetate, polycarbonates, polyesters, such as poly(ethylene terephthalate) and poly(ethylene naphthenate), and polyimides. Presently preferred substrates are poly(ethylene terephthalate) and polyimides. Typical film substrates have a thickness in the range of about 100 to 200 microns, although thicker and thinner layers can be employed.

The presently preferred photoconductor elements of this invention comprise: an electrically conductive support, a charge generation layer, and an electron transport layer comprising at least one cyclic bis-dicarboximide of Formula I.

The charge transport layer having at least one cyclic bis-dicarboximide of Formula I can be the top layer of the photoconductor element through which the light or activating energy passes to the charge generation layer, because the compounds of Formula I are substantially transparent to visible and near infrared region light. There will be little or no loss in incident light as such light passes through a charge transport layer of this invention. When the charge transport layer is the top layer, it provides the additional benefit of protecting the charge generation layer from abrasion caused when paper, cleaning brushes, or the like, contact the photoconductor element. These photoconductor elements of the invention are particularly useful as positively-charged photoconductor elements.

Photoconductor elements of this invention having a compound of Formula I as the electron charge transport agent display photosensitivity in the spectral range of about 400 to about 900 nm. The exact photosensitivity achieved in any given photoconductor element is dependent upon the choice of charge generation material(s), and the configuration of layer(s) in the photoconductor element. The term "photosensitivity" as used herein means the capacity of a photoconductor element to decrease in surface potential upon exposure to actinic radiation. For purposes of the present invention, photosensitivity is conveniently measured by corona charging the element to a certain potential, exposing the charged element to a monochromatic light and measuring the decrease of the surface potential. The amount of light necessary to discharge the element to a certain potential is defined as the "exposure requirement" for that potential. The exposure requirement to discharge the photoconductor element to half of its initial value is denoted $E_{0.5}$.

The photoconductor elements of this invention can employ various electrically conductive layers. For example, the conductive layer can be a metal foil which is laminated to the substrate. Suitable metal foils include those comprised of aluminum, zinc, copper, and the like. Alternatively, vacuum deposited metal layers upon a substrate are suitable and are presently preferred, such as vapor deposited silver, nickel, gold, aluminum, chromium, and metal alloys. The thickness of a vapor deposited metal layer can be in the range of about 20 to about 500 angstroms. Conductive layers can also comprise a particulate or dissolved organic or inorganic conductor or semiconductor distributed in a binder resin. For example, a conductive layer can comprise compositions of protective inorganic oxide and about 30 to about 70 weight percent of conductive metal particles, such as a vapor deposited conductive cermet layer as described in U.S. Pat. No. 3,880,657. Also see in this connection the teachings of U.S. Pat. No. 3,245,833 relating to conductive layers employed with barrier layers. Organic conductive layers can be employed, such as those comprised of a sodium salt of a carboxyester lactone of maleic anhydride in a vinyl acetate polymer, as taught, for example in U.S. Pat. Nos. 3,007,901 and 3,262,807. The substrate and the conductive layer can also be formulated as a consolidated layer which can be a metal plate or drum. For example, suitable plates or drums can be formed of metals such as aluminum, copper, zinc, brass and steel.

In the photoconductor elements of the invention, the conductive layer is optionally, but preferably, overcoated by a barrier adhesive or subbing layer. The barrier layer typically has a dry thickness in the range of about 0.01 to about 5 microns. Typical subbing layers are solvent soluble, film-forming polymers, such as, for example, cellulose nitrate, nylon, polyesters, copolymers of poly(vinyl pyrrolidone) and vinylacetate, and various vinylidene chloride-containing polymers. Preferred subbing layers are comprised of nylon, and polyacrylic and methacrylic esters. The barrier layer coating composition can also contain minor amounts of various optional additives, such as surfactants, levelers, plasticizers, and the like.

While any convenient method of application of a subbing layer can be used, it is presently preferred to dissolve the polymer in a solvent, and then to coat the solution over the conductive layer.

Preferably, the solvents are volatile, that is evaporable, at temperatures below about 150° C. Examples of suitable solvents include petroleum ethers; aromatic hydrocarbons, such as benzene, toluene, xylene, and mesitylene; ketones, such as acetone, and 2-butanone; ethers, such as tetrahydrofuran and diethyl ether; alkanols, such as isopropyl alcohol; and halogenated aliphatic hydrocarbons, such as methylene chloride, chloroform, and ethylene chloride. Presently preferred coating solvents are chlorinated aliphatic hydrocarbons. A nylon subbing layer is preferably coated from an alcohol. Mixtures of different solvents or liquids can also be employed.

The barrier layer coating composition is applied by using a technique such as knife coating, spray coating, spin coating, extrusion hopper coating, curtain coating, or the like. After application, the coating composition is conveniently air dried.

In addition to organic polymers, inorganic materials can be utilized for the formation of barrier layers. Silicon dioxide, for example, can be applied to a conductive support by vacuum deposition.

The charge generation layer is applied over the conductive layer, or over the barrier layer, if a barrier layer is employed.

The charge generating (or generation) layer is conveniently comprised of at least one conventional charge generation material that is typically dispersed in a polymeric binder. The layer can have a thickness that varies over a wide range, typical layer thicknesses being in the range of about 0.05 to about 5 microns. As those skilled in the art will appreciate, as layer thickness increases, a greater proportion of incident radiation is absorbed by a layer, but the likelihood increases of trapping a charge carrier which then does not contribute to image formation. Thus, an optimum thickness of a layer can constitute a balance between these competing influences.

Charge generation materials suitable for use in the charge generation layer comprise materials that are capable of generating electron/hole pairs upon exposure to actinic radiation in the presence of an electric field and transferring the electrons to an electron-transport agent. The charge generation material is present in a polymeric binder or is present as a separate solid phase. The process by which electron/hole pairs are generated may require the presence of an electron-transport agent. Suitable charge generation materials preferably are substantially incapable of generating and/or transferring electrons/hole pairs to an electron-transport agent in the absence of actinic radiation.

A wide variety of materials known in the art as charge generation materials can be employed including inorganic and organic compounds. Suitable inorganic compounds include, for example, zinc oxide, lead oxide, and selenium. Suitable organic materials include various particulate organic pigment materials, such as phthalocyanine pigments, and a wide variety of soluble organic compounds including metallo-organic and polymeric organic charge generation materials. A partial listing of representative materials may be found, for example, in Research Disclosure, Vol. 109, May, 1973, page 61, in an article entitled "Electrophotographic Elements, Materials and Processes", at paragraph IV(A) thereof. This partial listing of well-known charge generation materials is hereby incorporated by reference.

Examples of suitable organic charge generation materials include phthalocyanine pigments such as a bromoindium phthalocyanine pigment described in U.S. Pat. Nos. 4,666,802 and 4,727,139 or a titanylphthalocyanine pigment such as a titanyl tetrafluoropthalocyanine described in U.S. Pat. No. 4,701,396; various pyrylium dye salts, such as pyrylium, bispyrylium, thiapyrylium, and selenapyrylium dye salts, as disclosed, for example, in U.S. Pat. No. 3,250,615; fluorenes, such as 7,12-dioxo-13-dibenzo(a,h) fluorene, and the like; aromatic nitro compounds of the kind disclosed in U.S. Pat. No. 2,610,120; anthrones such as those disclosed in U.S. Pat. No. 2,670,284; quinones such as those disclosed in U.S. Pat. No. 2,670,286; thiazoles, such as those disclosed in U.S. Pat. No. 3,732,301; various dyes such as cyanine (including carbocyanine), merocyanine, triarylmethane, thiazine, azine, oxazine, xanthene, phthalein, acridine, azo, anthraquinone dyes, and the like, and mixtures thereof.

The charge generation material, or a mixture of charge generation materials, is usually applied from a solution or dispersion in a coating composition to form a charge generating layer in an element over a barrier layer of the type described herein. Also typically present as dissolved solids in a charge generation layer coating composition are a binder polymer and optional additives, such as surfactants, levelers, plasticizers, sensitizers, and the like. The solids comprising a charge generation layer on a 100 weight percent total basis typically comprise 1 to about 70 weight percent of charge-generation material, 0 to about 99 weight percent of polymeric binder, and 0 to about 50 weight percent of total additives. Preferably the coating composition contains from about 6 to about 15 weight percent of solids, the balance being solvent. Suitable solvents are those identified above in relation to the barrier layer. Presently preferred additives for a composition to be coated to form a charge generation layer are charge transport agents and surfactants.

Any hydrophobic organic polymer known to the photoconductor element art as a binder can be used for the polymeric binder in the charge generating layer. These polymers are film forming and are preferably organic solvent soluble, and, in solid form, display high dielectric strength and electrical insulating properties. Suitable polymers include, for example, styrene-butadiene copolymers;

polyvinyl toluene-styrene copolymers; silicone resins, styrene alkyd resins, silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetate); vinyl acetate-vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc.; polystyrene, nitrated polystyrene; polymethylstyrene; isobutylene polymers; polyesters, such as poly[4,4'-(2-norbornylidene)bisphenylene azelate-co-terephthalate(60/40)], and poly[ethylene-co-alkylene-bis(alkylene-oxyaryl)-phenylenedicarboxylate]; phenolformaldehyde resins; ketone resins; polyamides; polycarbonates; polythiocarbonates; poly[ethylene-co-isopropylidene-2,2-bis(ethyleneoxyphenylene-)terephthalate]; copolymers of vinyl haloarylates and vinyl acetate, such as poly(vinyl-m-bromobenzoate-co-vinyl acetate); chlorinated polyolefins such as chlorinated polyethylene; and the like. Preferred polymers are polyesters and polycarbonates.

One or more charge transport agents can be added to a charge generation layer coating composition, such as 1,1-bis(4-di-p-tolylaminophenyl)cyclohexane, as taught in U.S. Pat. No. 4,127,412, tri-p-tolylamine, and the like or, electron transport agents, such as compounds of Formula I, or any other electron transport agents known to the art. Coating aids, such as levelers, surfactants, cross linking agents, colorants, plasticizers, and the like, can also be added. The quantity of each of the respective additives present in a coating composition can vary, depending upon results desired and user preferences.

A charge generating layer composition is applied by coating the composition over the barrier layer using a technique such as above described for coating a barrier layer composition. After coating, the charge generating layer composition is usually air dried.

Instead of a charge generation material being dispersed in a polymeric binder, a charge generation layer can, in some cases, depending upon the charge generation material involved, be comprised substantially entirely of only such a material. For example, a perylene dicarboximide pigment of the Formula

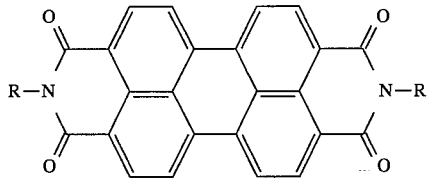

wherein R is an aryl or arylalkylenyl group, can be applied over an electrically conductive layer under vacuum by sublimination, such as under subatmospheric pressures of about $10^{-2}$ to about $10^{-5}$ mm Hg at temperatures in the range of about 200° to about 400° C.

The preferred charge generation material comprises titanylphthalocyanine or titanyl tetrafluorophthalocyanine pigment described in U.S. Pat. No. 4,701,396 incorporated herein by reference. The preferred binder in the charge generating layer is poly [4,4'-(2-norbornylidene)bisphenylene azelate-co-terephthalate(60/40)].

The charge transport layer is applied over the charge generation layer. When the charge transport layer contains at least one compound of Formula I, an electron-transporting charge transport layer is produced.

A charge transport layer, if desired, can contain, in addition to at least one compound of Formula I, at least one additional electron transport agent of a type known to the art. Suitable known electron transport agents include 2,4,7-trinitro-9-fluorenone, substituted 4-dicyanomethylene-4H-thiopyran 1,1-dioxides, and substituted anthraquinone biscyanoimines.

In the charge transport layer, the charge transport agent(s) are dispersed, and preferably dissolved, in an electrically insulating organic polymeric film forming binder. In general, any of the polymeric binders useful in the photoconductor element art can be used, such as described above for use in a charge generation layer. Additionally, the charge transport layer of this invention can utilize a polymeric binder which itself is a charge transport agent. Examples of such polymeric binders include poly(vinylcarbazole). The most preferred binders include polycarbonates such as bisphenol A polycarbonate and polyesters such as poly[4,4'-(2-norbornylidene)bisphenylene azelate-co-terephthalate(60/40)].

On a 100 weight percent total solids basis, a charge transport layer preferably comprises about 10 to 70 weight percent of at least one Formula I compound and about 30 to about 90 weight percent of binder. Typically, a charge transport layer has a thickness in the range of about 10 to about 25 microns, although thicker and thinner layers can be employed.

A charge transport layer of this invention can be produced in a bipolar form, if desired, by additionally incorporating into the layer at least one hole transport agent. Such an agent preferentially accepts and transports positive charges (holes). If employed, the quantity of hole transport agent(s) present in a charge transport layer on a total layer weight basis is preferably in the range of about 10 to about 50 weight percent, although larger and smaller quantities can be employed.

Examples of suitable organic hole transport agents known to the prior art include:

1. Carbazoles including carbazole, N-ethyl carbazole, N-isopropyl carbazole, N-phenyl carbazole, halogenated carbazoles, various polymeric carbazole materials such as poly(vinyl carbazole), halogenated poly(vinyl carbazole), and the like.
2. Arylamines including monoarylamines, diarylamines, triarylamines and polymeric arylamines. Specific arylamine organic photoconductors include the nonpolymeric triphenylamines illustrated in U.S. Pat. No. 3,180,730; the polymeric triarylamines described in U.S. Pat. No. 3,240,597; the triarylamines having at least one of the aryl radicals substituted by either a vinyl radical or a vinylene radical having at least one active hydrogen-containing group, as described in U.S. Pat. No. 3,567,450; the triarylamines in which at least one of the aryl radicals is substituted by an active hydrogen-containing group, as described by U.S. Pat. No. 3,658,520; and tritolylamine.
3. Polyarylakanes of the type described in U.S. Pat. Nos. 3,274,000; 3,542,547; 3,625,402; and 4,127,412.
4. Strong Lewis bases, such as aromatic compounds, including aromatically unsaturated heterocyclic compounds free from strong electron-withdrawing groups. Examples include tetraphenylpyrene, 1-methylpyrene, perylene, chrysene, anthracene, tetraphene, 2-phenylnaphthalene, azapyrene, fluorene, fluorenone, 1-ethylpyrene, acetyl pyrene, 2,3-benzochrysene, 3,4-benzopyrene, 1,4-bromopyrene, phenylindole, polyvinyl carbazole, polyvinyl pyrene, polyvinyltetracene, polyvinyl perylene and polyvinyl tetraphene.

5. Hydrazones, including the dialkyl-substituted aminobenzaldehyde-(diphenylhydrazones) of U.S. Pat. No. 4,150,987; alkylhydrazones and arylhydrazones as described in U.S. Pat. Nos. 4,554,231; 4,487,824; 4,481,271; 4,456,671; 4,446,217; and 4,423,129, which are illustrative of the hydrazone hole transport agents.

Other useful hole transport agents are described in Research Disclosure, Vol. 109, May, 1973, pages 61–67 paragraph IV(A)(2) through (13).

In addition to an electron transport agent of Formula I, and optionally additional charge transport agent(s) and a binder polymer, the charge transport layers in the photoconductor elements of this invention may contain various optional additives, such as surfactants, levelers, plasticizers, and the like. On a 100 weight percent total solids basis, a charge transport layer can contain up to about 15 weight percent of such additives, although it preferably contains less than 1 weight percent of such additives.

The charge transport layer solid components are conveniently preliminarily dissolved in a solvent to produce a charge transport layer composition containing about 8 to about 20 weight percent solids with the balance up to 100 weight percent being the solvent. The solvents used can be those hereinabove described.

Coating of the charge transport layer composition over the charge generation layer can be accomplished using a solution coating technique such as knife coating, spray coating, spin coating, extrusion hopper coating, curtain coating, and the like. After coating, the charge transport layer composition is usually air dried.

A charge transport layer can be formed of two or more successive layers each of which has the same or different total solids composition. In such event at least one charge transport sublayer contains at least one compound of Formula I.

Preferred photoconductor elements of this invention characteristically display dark decay values of no more than about 20 V/sec, more preferably no more than 5 V/sec. The term "dark decay" as used herein means the loss of electric charge and consequently, electrostatic surface potential from a charged photoconductor element in the absence of activating radiation.

For present purposes of measuring dark decay, a multilayered photoconductor element of the type under consideration herein is charged upon its charge transport layer by use of a corona discharge device to a surface potential in the range of about +300 to about +600 volts. Thereafter, the rate of charge dissipation and decrease of surface potential in volts per second is measured. The element is preliminarily dark adapted and maintained in the dark without activating radiation during the evaluation using ambient conditions of temperature and pressure.

Preferred photoconductor elements of this invention display reusability, that is, the ability to undergo repeated cycles of charging and discharging without substantial alteration of their electrical properties.

Those skilled in the art will appreciate that other variations in the structure of photoconductor elements incorporating a charge transport layer containing a compound of Formula I are possible and practical. For example, various different layer arrangements can be employed. Thus, a transport layer can be positioned between two charge generation layers which can have the same or different respective compositions and layer thicknesses. Also, a charge generation layer can be positioned between two charge-transport layers only one of which may contain a compound of Formula I.

The invention is further illustrated by the following Examples:

EXAMPLE 1

PREPARATION OF N,N'-BIS(1,2-DIMETHYLPROPYL)-1,4,5,8-NAPHTHALENEDICARBOXIMIDE (COMPOUND 1)

A mixture of 80.5 g of 1,4,5,8-naphthalenetetracarboxylic dianhydride (NTDA) and 73 mL of (±)-1,2-dimethylpropylamine and 350 mL of 4-picoline (bp 145° C.) was refluxed for 4 hours. After cooling to room temperature and diluting with 350 mL methanol, the precipitate was collected by suction filtration with methanol washing. The air-dried filter cake was dissolved in 1,000 mL of dichloromethane, heated to boiling, treated with 5 g of decolorizing carbon, filtered hot, and concentrated on a rotary evaporator. The solid residue was dissolved in 215 mL of dichloromethane and added dropwise to 2,000 mL of rapidly stirring methanol. The precipitate was collected by suction filtration, with methanol washing, and dried under vacuum at 50° C. for two days to yield 95 g (78%) of Compound 1 as a pale yellowish powder, melting point (mp) 194°–196° C.

EXAMPLES 2–18

PREPARATION OF ADDITIONAL BIS-DICARBOXIMIDES

Symmetrical bis-dicarboximides were synthesized by the procedure of Example 1 except that the amine varied and for some quinoline (Qu) was used instead of 4-picoline (Pc) in the reaction mixture. The amine, solvent, percent yield and melting point of each of the compounds produced are listed in Table 2.

TABLE 2

PREPARATION OF BIS-DICARBOXIMIDES

| Example | Compound | Amine (R—$NH_2$), R= | Solvent | % Yield | mp (°C.) |
|---|---|---|---|---|---|
| 2 | 2 | —$CH(CH_3)CH_2CH_3$ | Pc | 76 | 198–200 |
| 3 | 3 | —$CH(CH_3)CH_2CH(CH_3)_2$ | Qu | 19 | 144–147 |
| 4 | 4 | —$CH(CH_2CH_3)_2$ | Qu | 75 | 214–216 |
| 5 | 5 | —$CH_2CH_2CH(CH_3)_2$ | Qu | 86 | 371–379 |
| 6 | 6 | —$CH_2CH(CH_3)CH_2CH_3$ | Qu | 82 | 376–379 |
| 7 | 7 | —$CH(CH_3)CH_2CH_2CH_3$ | Qu | 71 | 179–182 |
| 8 | 8 | —$CH_2CH(CH_3)_2$ | Qu | 88 | 285–287 |
| 9 | 9 | —$CH(CH_3)_2$ | Pc | 90 | 305–313 |
| 10 | 10 | -cyclopentyl | Pc | 84 | 292–294 |
| 11 | 11 | —$CH_2CH_2CH_2CH_2CH_3$ | Qu | 32 | 214–224 |
| 12 | 12 | —$CH_2CH{=}CH_2$ | Pc | 90 | 262–268 |
| 13 | 13 | —$CH(CH_2OH)CH_2CH_3$ | Pc | 73 | 247–249 |
| 14 | 14 | -cyclohexyl | Pc | 95 | 359–368 |
| 15 | 15 | -cyclobutyl | Pc | 88 | 269–273 |
| 16 | 16 | -cyclopropyl | Pc | 89 | 376–384 |

TABLE 2-continued

PREPARATION OF BIS-DICARBOXIMIDES

| Example | Compound | Amine (R—$NH_2$), R= | Solvent | % Yield | mp (°C.) |
|---|---|---|---|---|---|
| 17 | 17 | —$CH(CH_3)CH_2CH_2Ph$ | Pc | 75 | 150–153 |
| 18 | 18 | —$CH(CH_3)CH_2CO_2Et$ | Pc | 45 | 153–158 |

EXAMPLE 19

SOLUBILITIES OF BIS-DICARBOXIMIDES IN DCM

The solubilities of the bis-dicarboximides were tested in dichloromethane (DCM). The solubility was tested by measuring the approximate volume of DCM required to dissolve one gram of the compound at room temperature. The results are listed in Table 3.

TABLE 3

SOLUBILITIES OF BIS-DICARBOXIMIDES IN DCM

| Compound | Solubility (mL DCM/g) |
|---|---|
| 1 | 2 |
| 2 | 6 |
| 3 | 2 |
| 4 | 10 |
| 5 | >100 |
| 6 | 70 |
| 7 | 20 |
| 8 | 39 |
| 9 | 16 |
| 10 | 30 |
| 11 | 20 |
| 12 | 45 |
| 13 | >100 |
| 14 | >40 |
| 15 | 160 |
| 16 | >1000 |

COMPARATIVE EXAMPLE A

SOLUBILITIES OF COMPARATIVE COMPOUNDS IN DCM

The solubilities of bis-dicarboximides outside the scope of this invention were tested as described in Example 19. The results are in Table 4. The compounds were made as taught in U.S. Pat. No. 4,992,349, incorporated herein by reference.

TABLE 4

SOLUBILITIES OF COMPARATIVE COMPOUNDS IN DCM

| Comparative bis-dicarboximide | Solubility (mL DCM/g) |
|---|---|
| N,N'-bis(4-tert-butylphenyl)-1,4,5,8-naphthalenedicarboximide | 19 |
| N,N'-bis(3-phenylpropyl)-1,4,5,8-napthalenedicarboximide | 27 |

EXAMPLE 20

PREPARATION OF A MIXTURE OF BIS-DICARBOXIMIDE COMPOUNDS

A highly soluble mixture of one unsymmetric and two symmetric bis-dicarboximides was prepared. A solution of 3.33 mL of sec-butylamine, 3.8 mL (±)-1,2-dimethylpropylamine and 25 mL of 4-picoline was added dropwise to a solution of 8.05 g NTDA and 75 mL 4-picoline. The mixture was refluxed for three hours, cooled to room temperature, and concentrated under vacuum to 13.6 g of a dark brown, crystallizing oil. Trituration with methanol and suction filtration produced 10.5 g of a light brown solid. The solid was dissolved in 120 mL of dichloromethane, heated to boiling, treated with 0.5 g of decolorizing carbon, filtered hot, and concentrated on a rotary evaporator. The oily residue was dissolved in 10 mL of dichloromethane and added dropwise to 115 mL of rapidly stirring methanol. The precipitate was collected by suction filtration, with methanol washing to produce 9.5 g of a pale yellowish powder, mp 124°–142° C. Analysis by high pressure liquid chromatography showed that the sample was a mixture of Compound 1 (25%), Compound 2 (32%), and an unsymmetric Compound of Formula I where $Q^1$ was —$CH(CH_3)CH_2CH_3$ and $Q^2$ was —$CH(CH_3)CH(CH_3)_2$ (43%). The unsymmetric bis-dicarboximide mixture will be referred to as Compound 19.

EXAMPLE 21

PREPARATION OF PHOTOCONDUCTOR ELEMENTS TO TEST THE SOLUBILITIES OF BIS-DICARBOXIMIDES IN POLYMERIC BINDERS

An approximately 1 micron thick charge-generation layer consisting of acid-pasted titanyl tetrafluorophthalocyanine and poly[4,4'-(2-norbornylidene)bisphenylene azelate-co-terephthalate (60/40)] polymer binder in a 2:1 weight ratio was extrusion hopper coated from DCM onto a suitable conductive support and barrier layer. The conductive support consisted of an aluminum layer deposited by vacuum evaporation to an optical density of 0.4 onto a poly(ethylene terephthalate) Estar™ substrate, available from the Eastman Kodak Company. The barrier layer was an approximately 500 Å thick layer of silica deposited in vacuo. An approximately 10 micron thick charge-transport layer comprising Compound 1 in poly[4,4'-(2-norbornylidene)bisphenylene azelate-co-terephthalate (60/40)] polymer binder was solution coated onto the charge-generation layer from a 10 percent solids solution in DCM.

Photoconductor elements containing 10, 20, 30, 40, 50 and 60 weight percent of Compound 1 exhibited no visual evidence of crystallization over a three week period at room temperature.

COMPARATIVE EXAMPLE B

PREPARATION OF PHOTOCONDUCTOR ELEMENTS WITH COMPARATIVE COMPOUNDS

The same two charge-transport compounds used in Comparative Example A were used to make photoconductor elements as described in Example 21. Films containing 39, 52, and 60 weight percent of the N,N'-bis(4-tert-butylphenyl)-1,4,5,8-naphthalenedicarboximide crystallized immediately as the coating solution dried, as indicated by a cloudy appearance. Photoconductor elements containing 25 and 30 weight percent of N,N'-bis(3-phenylpropyl)-1,4,5,8-napthalenedicarboximide also crystallized immediately.

EXAMPLE 22

ELECTROPHOTOGRAPHIC PROPERTIES

A photoconductor element was prepared as described in Example 21 having 40 weight percent of Compound 1, and a second photoconductor element was prepared as described in Example 21 having 37.2 weight percent of the Compound 2. The bis-dicarboximides were present in the photoconductor elements at equal molar concentrations.

The photoconductor element was corona charged to a positive surface potential of 300 V in the dark. The decrease of the surface potential in the dark, known as dark decay, was measured over a period of 2 seconds. Then the photoconductor element was exposed to monochromatic radiation of low intensity, 2.75 erg/cm$^2$/sec, at 830 nm, for a period of approximately 10 seconds, which was a sufficient time to decrease the 300 V to a residual potential. The residual potential is the surface potential that will not decrease upon further exposure to radiation. The exposure requirement $E_{0.5}$, which is the amount of radiation necessary to discharge the photoconductor element to half of the original surface potential on the photoconductor element, was measured for each of the photoconductive elements and the results are in Table 5.

TABLE 5

ELECTROPHOTOGRAPHIC PROPERTIES OF BIS-DICARBOXIMIDES

| Charge transport agent | wt % electron transport agent | Dark Decay (V/sec) | $E_{0.5}$ (erg/cm$^2$) |
|---|---|---|---|
| 1 | 40 | <1 | 3.7 |
| 2 | 37.2 | <1 | 4.0 |

COMPARATIVE EXAMPLE C

ELECTROPHOTOGRAPHIC PROPERTIES OF COMPARATIVE COMPOUNDS

Two photoconductor elements were made as described in Example 21 except that the electron transport agents were 4-dicyanomethylene-2-phenyl-6-(4-tolyl)-4H-thiopyran-1,1-dioxide and N,N'-dicyano-2-tert-butyl-9,10-anthraquinonediimine. The 4-dicyanomethylene-2-phenyl-6-(4-tolyl)-4H-thiopyran-1,1-dioxide was synthesized as described in Example 1 of U.S. Pat. No. 5,013,849, which is incorporated herein by reference. The N,N'-dicyano-2-tert-butyl-9,10-anthraquinonediimine was synthesized as described in "Preparation A" in U.S. Pat. No. 4,913,996, which is incorporated herein by reference. The molar concentrations of the charge transport agents in the photoconductor elements were the same as in Example 22. The dark decays and the exposure requirements were determined the same way as described in Example 22 and are recorded in Table 6.

TABLE 6

ELECTROPHOTOGRAPHIC PROPERTIES OF COMPARATIVE COMPOUNDS

| Charge transport agent | wt % electron transport agent | Dark Decay (V/sec) | $E_{0.5}$ (erg/cm$^2$) |
|---|---|---|---|
| 4-dicyanomethylene-2-phenyl-6-(4-tolyl)-4H-thiopyran-1,1-dioxide | 35.2 | 5 | 2.1 |
| N,N'-dicyano-2-tert-butyl-9,10-anthraquinonediimine | 30.7 | 2.5 | 4.4 |

EXAMPLE 23

ELECTRON MOBILITIES

Photoconductor elements containing different weight percentages of Compound 1 were prepared as in Example 21. Then a semitransparent gold electrode was vacuum deposited onto the layer containing Compound 1. The optical density of the electrode was approximately 0.5. The electron mobility of the elements was measured as a function of concentration and electric field strength. The electron mobility measurements were made by conventional time-of-flight techniques as described in general in P. M. Borsenberger and D. S. Weiss, *Organic Photoreceptors for Imaging Systems*, Marcel Dekker, New York, 1993, p. 279, and in more detail in U.S. Pat. No. 5,272,032, incorporated herein by reference. The results of this test are compiled in Table 7. Electric field strength is denoted E. The units of mobility are cm$^2$/V-sec.

TABLE 7

ELECTRON MOBILITIES

| Wt % Compound 1 | Mobility at E = 10 V/μm | Mobility at E = 20 V/μm | Mobility at E = 40 V/μm |
|---|---|---|---|
| 60% | $4.2 \times 10^{-6}$ | $6.2 \times 10^{-6}$ | $1.0 \times 10^{-5}$ |
| 50% | $1.1 \times 10^{-6}$ | $1.7 \times 10^{-6}$ | $2.7 \times 10^{-6}$ |
| 40% | $3.1 \times 10^{-7}$ | $4.9 \times 10^{-7}$ | $8.0 \times 10^{-7}$ |
| 30% | $4.8 \times 10^{-8}$ | $6.2 \times 10^{-8}$ | $1.1 \times 10^{-7}$ |

COMPARATIVE EXAMPLE D

ELECTRON MOBILITIES OF COMPARATIVE COMPOUNDS

The electron mobility tests described in Example 23 were repeated for photoconductor elements made according to Comparative Example C except they contained 40 weight percent of the electron transport agents.

Mobility tests were also performed on an element disclosed in U.S. Pat. No. 5,266,429 in which the charge-transport layer consisted solely of the polymer

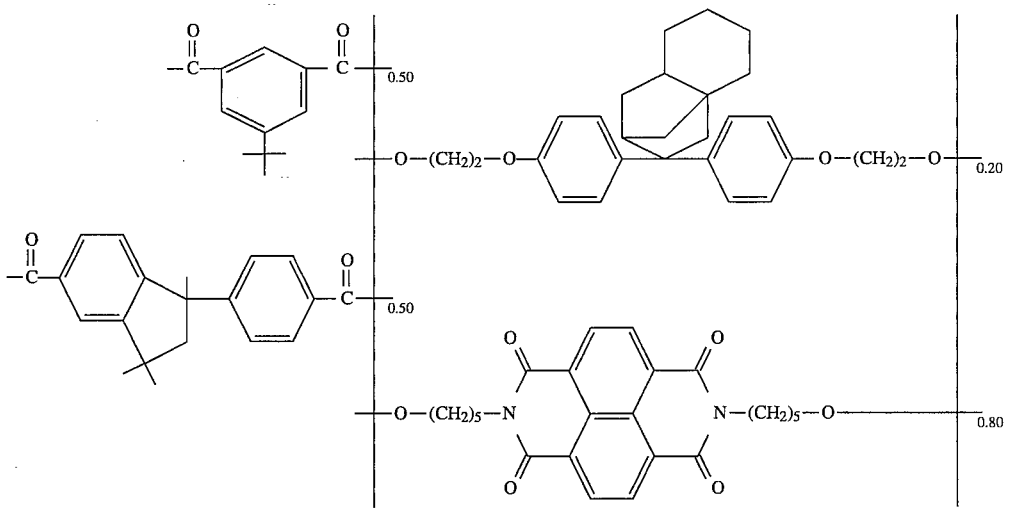

denoted hereinafter as polymer C.

The result of those tests are compiled in Table 8. The units of mobility are $cm^2/V$-sec.

TABLE 8

ELECTRON MOBILITIES OF COMPARATIVE COMPOUNDS

| Electron Transport Agent | Wt % | Mobility at E = 10 V/μm | Mobility at E = 20 V/μm | Mobility at E = 40 V/μm |
|---|---|---|---|---|
| 4-dicyanomethylene-2-phenyl-6-(4-tolyl)-4H-thiopyran-1,1-dioxide | 40% | $1.7 \times 10^{-7}$ | $2.6 \times 10^{-7}$ | $4.8 \times 10^{-7}$ |
| N,N'-dicyano-2-tert-butyl-9,10-anthraquinonediimine | 40% | $2.5 \times 10^{-8}$ | $4.7 \times 10^{-8}$ | $1.1 \times 10^{-7}$ |
| Polymer C | 100% | | | $1.8 \times 10^{-8}$ |

These examples illustrate the usefulness of the photoconductive elements of this invention. Variations within the spirit and scope of the invention are possible and will present themselves to those of ordinary skill in the art.

We claim:

1. A photoconductor element comprising: an electrically conductive layer, a charge generation material and an electron transport agent in a polymeric binder, said electron transport agent comprising at least one cyclic bis-dicarboximide compound of Formula (I):

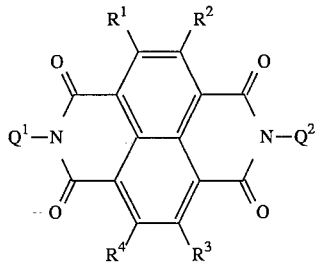

(I)

wherein:

$Q^1$ and $Q^2$, which may be the same or different, are branched alkyl; unsubstituted straight-chain alkyl; unsubstituted cyclic alkyl; alkyl-substituted cyclic alkyl; unsubstituted, straight-chain, unsaturated alkyl; or H, wherein $Q^1$ and $Q^2$ cannot both be H; and $R^1$, $R^2$, $R^3$, and $R^4$, which may be the same or different, are hydrogen, alkyl having 1 to 4 carbon atoms, alkoxy having 1 to 4 carbon atoms, or halogen.

2. The photoconductor element of claim 1 wherein said $Q^1$ and $Q^2$, which may be the same or different, are branched alkyl; unsubstituted straight-chain alkyl; unsubstituted, straight-chain, unsaturated alkyl; or H, wherein $Q^1$ and $Q^2$ cannot both be H; and $R^1$, $R^2$, $R^3$, and $R^4$, which may be the same or different, are hydrogen, alkyl having 1 to 4 carbon atoms, alkoxy having 1 to 4 carbon atoms, or halogen.

3. The photoconductor element of claim 1, wherein said unsubstituted, straight-chain, unsaturated alkyl is an alkylene or alkyne.

4. The photoconductor element of claim 1, wherein said unsubstituted, cyclic alkyl is selected from the group consisting of cyclopentyl and cyclohexyl.

5. The photoconductor element of claim 1, wherein said unsubstituted, straight-chain alkyl is selected from the group consisting of propyl, butyl and pentyl.

6. The photoconductor element of claim 1, wherein said branched alkyl consisting of 3 to 10 carbon atoms.

7. The photoconductor element of claim 1, wherein said branched alkyl consisting of 3 to 7 carbon atoms.

8. The photoconductor element of claim 1, wherein said branched alkyl consists of unsaturated hydrocarbon groups or functional groups; said functional groups being selected from the group consisting of halogen, hydroxy, nitro, amino, alkylsulfonyl, cyano, alkoxy, and carboalkoxy.

9. The photoconductor element of claim 1, wherein at least one of said $Q^1$ and $Q^2$ is selected from the group consisting of:

$$-CH(R^5)R^6,\ -CH(R^5)CH(R^6)R^7 \text{ and } -CH(R^5)CH_2CH(R^6)R^7$$

wherein $R^5$, $R^6$ and $R^7$ which may be the same or different, are selected from the group consisting of straight chain alkyls, cyclic alkyls, unsaturated hydrocarbon groups and any of the previous groups substituted with functional groups; said functional groups being selected from the group consisting of halogen, hydroxy, nitro, amino, alkylsulfonyl, cyano, alkoxy, and carboalkoxy.

10. The photoconductor element of claim 9, wherein said unsaturated hydrocarbon groups are selected from the group consisting of vinyl, alkylenyl, alkynyl, and aryl.

11. The photoconductor element of claim 9 wherein said $R^5$, $R^6$ and $R^7$ are unsubstituted straight chain alkyl groups having 1 to 3 carbons.

12. The photoconductor element of claim 1 wherein at least one of said $Q^1$ and $Q^2$ is $$-CH(R^5)R^6$$

wherein $R^5$ is a methyl or ethyl group and $R^6$ is an unsubstituted alkyl group consisting of 1 to 4 carbons.

13. The photoconductor element of claim 1, wherein said cyclic bis-dicarboximide possesses a melting point less than or equal to 200° C.

14. A photoconductor element comprising: an electrically conductive layer, a charge generating layer and a charge transport layer comprising a polymeric binder and at least one cyclic bis-dicarboximide of Formula (I):

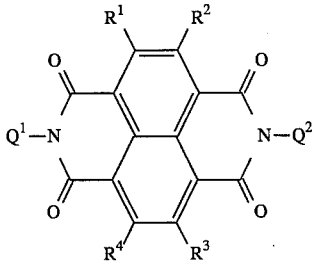

(I)

wherein:

$Q^1$ and $Q^2$, which may be the same or different, are branched alkyl; unsubstituted straight-chain alkyl; unsubstituted cyclic alkyl; alkyl-substituted cyclic alkyl, unsubstituted, straight-chain, unsaturated alkyl; or H, wherein $Q^1$ and $Q^2$ cannot both be H; and $R^1$, $R^2$, $R^3$, and $R^4$, which may be the same or different, are hydrogen, alkyl having 1 to 4 carbon atoms, alkoxy having 1 to 4 carbon atoms, or halogen.

15. The photoconductor element of claim 14, wherein said $Q^1$ and $Q^2$ are the same.

16. The photoconductor element of claim 14, wherein at least one of said $Q^1$ and $Q^2$ consists of a group having a molecular weight less than 134.

17. The photoconductor element of claim 14, wherein at least one of said $Q^1$ and $Q^2$ consists of a group having a molecular weight less than 99.

18. The photoconductor element of claim 14, wherein said cyclic bis-dicarboximide possesses a solubility in dichloromethane of greater than 5 grams in 100 mL dichloromethane.

19. The photoconductor element of claim 14, wherein said charge transport layer comprises about 10 to about 70 weight percent of said cyclic bis-dicarboximide and about 30 to about 90 weight percent of said binder on a 100 weight percent total solids basis.

20. The photoconductor element of claim 14, wherein said cyclic bis-dicarboximide is selected from the group consisting of N,N'-bis(1,2-dimethylpropyl)-1,4,5,8-naphthalenedicarboximide; N,N'-bis(1,3-dimethylbutyl)-1,4,5,8-naphthalenedicarboximide; N,N'-bis(1-ethylpropyl)-1,4,5,8-naphthalenedicarboximide; N,N'-bis-(1-methylpropyl)-1,4,5,8-naphthalenedicarboximide; and N,N'-bis(1-methyl-3-phenylpropyl)-1,4,5,8-naphthalenedicarboximide.

* * * * *